US006119560A

United States Patent [19]

Anderson et al.

[11] Patent Number: 6,119,560

[45] Date of Patent: Sep. 19, 2000

[54] TELESCOPING MAGNET FOLDING SCREWDRIVER

[76] Inventors: Wayne Anderson, 65 Grove St., Northport, N.Y. 11768; Paolo Cassutti, 8 N. Creek Rd., Northport, N.Y. 11729

[21] Appl. No.: 09/237,458

[22] Filed: Jan. 26, 1999

Related U.S. Application Data

[60] Division of application No. 08/904,665, Aug. 1, 1997, which is a continuation-in-part of application No. 08/620,471, Mar. 22, 1996, abandoned, and a continuation-in-part of application No. 08/451,398, May 26, 1995, Pat. No. 5,711,194.

[51] Int. Cl.[7] ..... B25B 23/00

[52] U.S. Cl. ..... 81/440; 7/168; 7/901

[58] Field of Search ..... 81/437–440; 30/123, 30/151, 164, 155, 161; 7/118, 165, 168, 901; 362/119, 120; 294/24, 65.5

[56] References Cited

U.S. PATENT DOCUMENTS 4,448,097 5/1984 Rocca .
5,320,004 6/1994 Hsiao .
5,669,492 9/1997 Chao .
5,809,600 9/1998 Cachet .
5,896,606 4/1999 Huang .
5,901,622 5/1999 Sweeny .

*Primary Examiner*—D. S. Meislin
*Attorney, Agent, or Firm*—Lackenbach Seigel Marzullo Aronson & Greenspan, P.C.

[57] ABSTRACT

A hand tool includes interchangeable screwdriver bits and a pivoted sleeve which pivots from an inoperable position to an operable position, and one of the screwdriver bits is slidably non-rotatably operably disposed in the operable position. The hand tool also includes a pivoted telescoping magnet which is pivoted from an inoperable position to an operable position for extendibly magnetically holding a screw. The hand tool is alternatively operable as a screwdriver and telescoping magnet.

5 Claims, 9 Drawing Sheets

12'
22
12'

22
12'
12'

22
11'
12'

FIG. 19
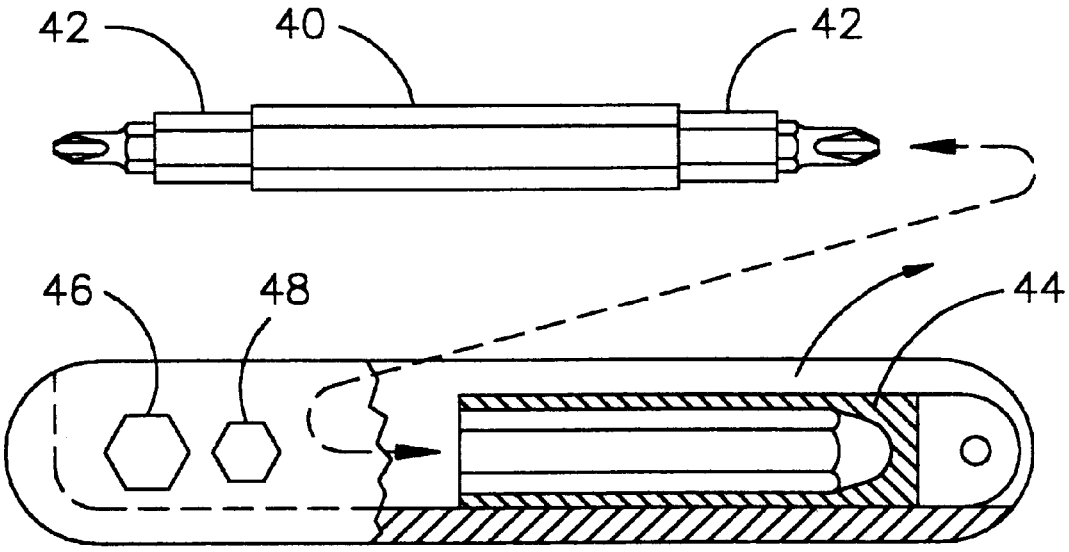
FIG. 18
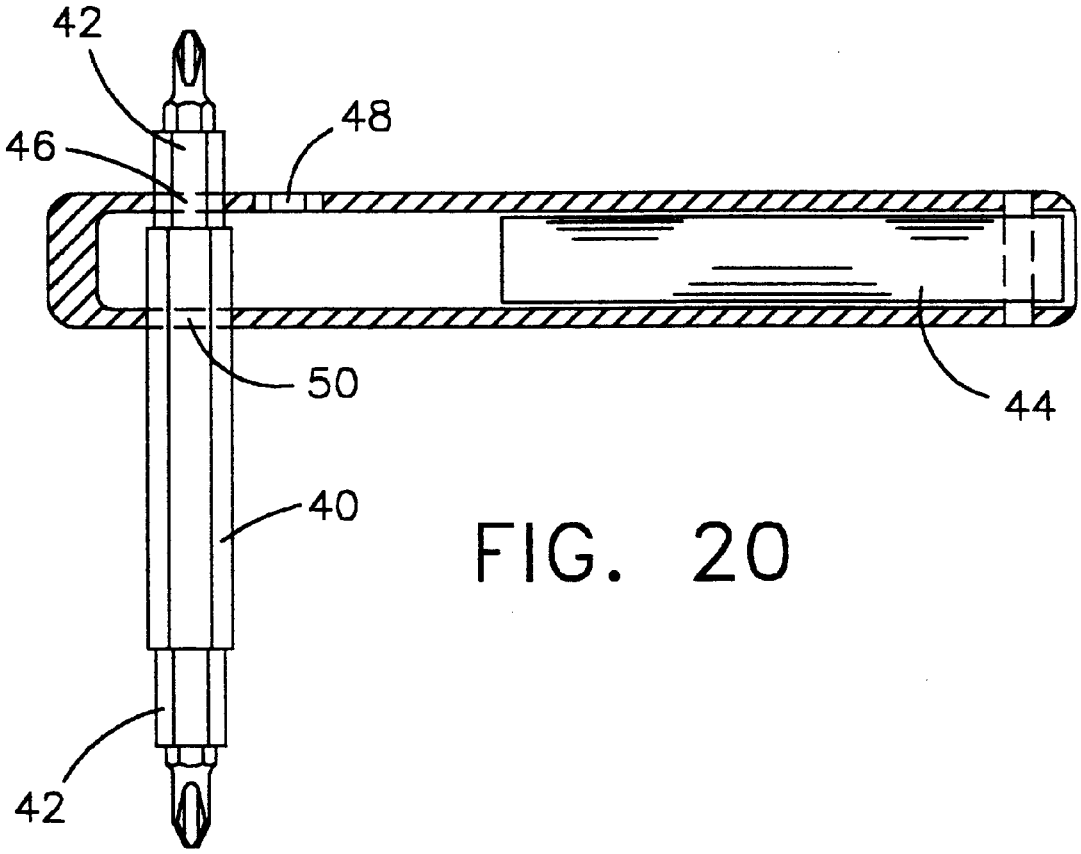
FIG. 20

TELESCOPING MAGNET FOLDING SCREWDRIVER

PRIOR RELATED APPLICATIONS

This application is a division of U.S. Ser. No. 08/904,665, filed Aug. 1, 1997, which is a continuation-in-part application of U.S. Ser. No. 08/620,471, filed Mar. 22, 1996, abandoned and U.S. Ser. No. 08/904,665 is also a continuation-in-part of U.S. Ser. No. 08/451,398, filed May 26, 1995, now U.S. Pat. No. 5,711,194.

This invention relates to an improved hand tool and to an improved multibit folding screwdriver tool; and more particularly to a hex key tool having in addition to a set of conventional hex keys, a 4-in-1 or 8-in-1 driver tool, such as disclosed in our copending U.S. patent applications Ser. Nos. 08/451,398, filed May 26, 1995, and 08/620,471, filed Mar. 22, 1996, both of which are intended to be and are hereby incorporated herein by reference. Also, this application relates to our copending U.S. patent application, entitled "Improved Hand/Survival Tool Having Multiple Implements" serial number (not yet known), filed concurrently with the instant patent application on Aug. 1, 1997.

BACKGROUND OF THE INVENTION

Heretofore, hex key tools made and sold by various well-known manufacturers, such as Allen, a Daneher Group of West Hartford, Conn. 06110, comprise either a set of loose hex keys in a pouch, or a set of hex keys pivotably mounted on one or both ends of a small handle, whereby the hex keys are stored between the sides of a handle, and individually pivoted outwardly to be used either in a right angle position or in an extending position axially aligned with the longitudinal axis of the handle. Other fold-up hex key sets include at most two or three separately pivoted screwdriver blades, such as a slotted blade and a Phillips type screwdriver. While such conventional tools are handy, they have limited use and do not have multiple drive bits of different shapes and/or sizes or one or more pivoted drive tools embodying an outer sleeve and an inner sleeve removably fixed relative thereto, and having therein replaceable drive bits for torquing fasteners or nuts.

SUMMARY OF THE INVENTION

The improved hand tool of the invention incorporates with or without a hex key set, a 4-in 1 or 8-in-1 driver tool which is pivotable at an end of the tool handle. With such a driver tool and its multiple drive bits, removably secured to mateable drive sleeves, the tool of the present invention enables a collection of various sizes and types of drive bits, such as Phillips, flat, star, etc., to be immediately available to the user of such tool, thereby eliminating the need for seeking out a different tool. Mechanics, machinists and other tradespeople, as well as "do-it-yourselfers," have a clear need for such improved hand tool since it eliminates having to have in hand on any job multiple tools of various sizes and types, and contributes to saving space in one's toolbox, besides being of economic benefit in that fewer overall tools need be purchased by the user. In addition, other pivotable tools, such as a flashlight and/or telescoping magnetic pick-up may also be employed in the practice of the invention.

BRIEF DESCRIPTION OF THE DRAWINGS

FIG. 10 illustrates a longitudinal section showing a pair of 4-in 1 drive tools axially in line with the longitudinal axis of the handle, but with one of the drive tools stored and the other ready for use; and FIG. 11 shows both 4-in 1 drive tools stored between the side walls of the handle.

FIGS. 18–20 are views similar to that of FIGS. 16 and 17, except that the 8-in-1 (or 4-in -1 if desired) drive tool is also provided with one or more crossbores for torquing the hexagonal sleeves or drive bits using the handle as a lever arm.

DESCRIPTION OF THE PREFERRED EMBODIMENTS

Figure 1:
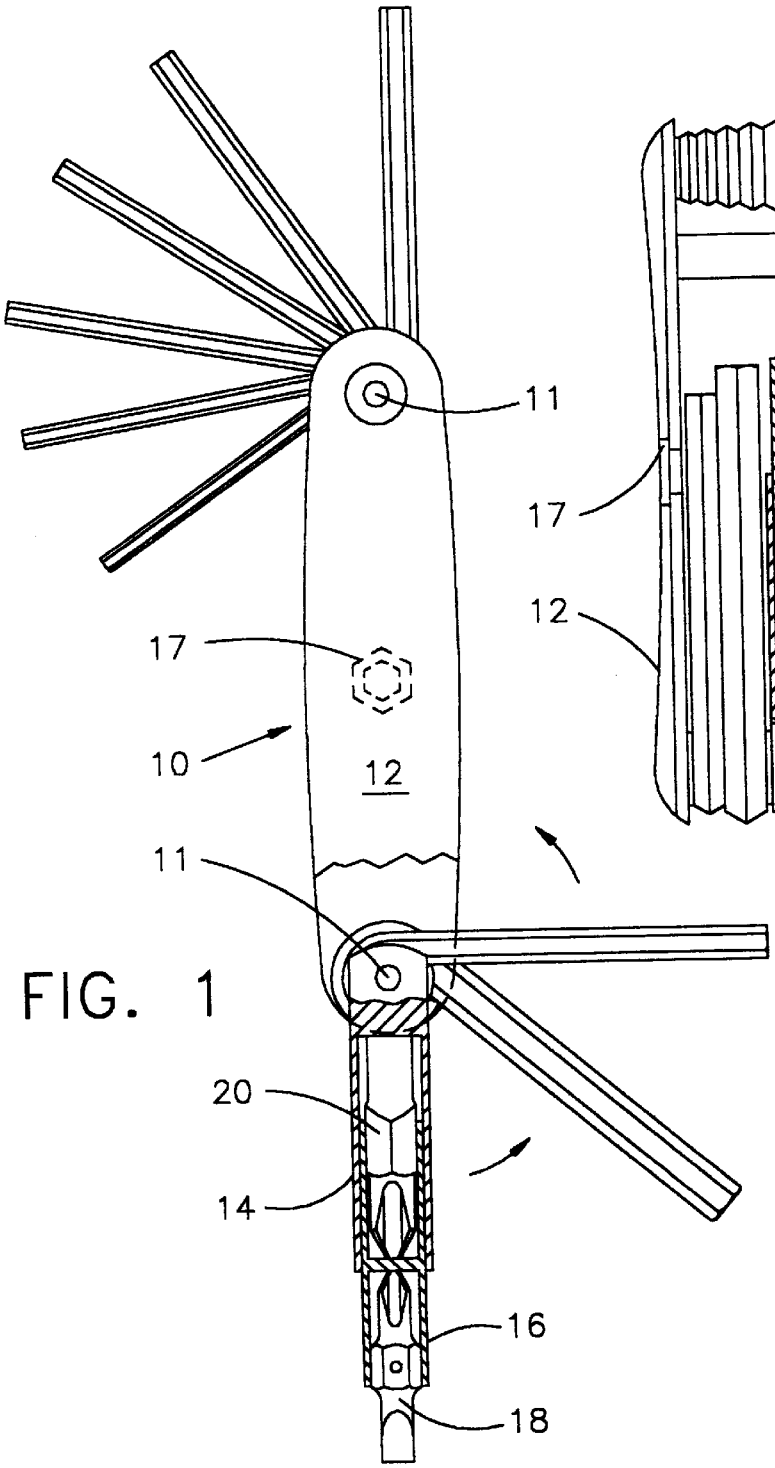
FIG. 1 is a side elevational view, partly broken away, of the improved hex key hand tool of the present invention with various sized hex keys pivoted to both ends of the tool handle, and with a 4-in-1 driver tool pivotably mounted at one end thereof.
Figure 2:
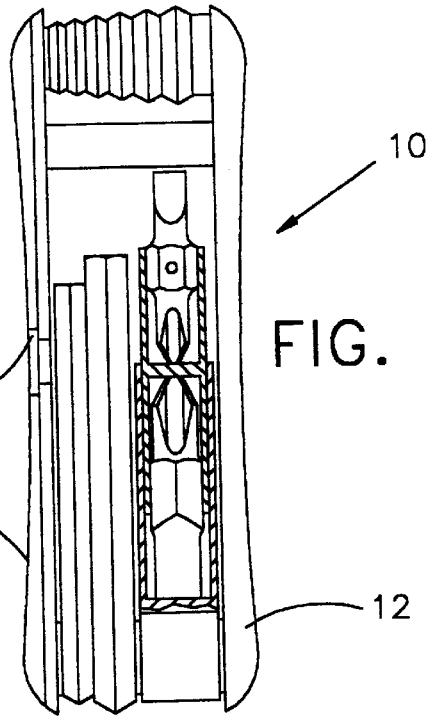
FIG. 2 is a plan view looking into the cavity/compartment of the improved hand tool of FIG. 1, but with the 4-in 1 driver tool, and all of the set of hex keys, shown in the stored condition, except for the set of hex keys grouped at one end which keys are shown extending downwardly out of view, but at right angles to the handle.

With reference to FIGS. 1–20, and in particular FIGS. 1 and 2, there is shown a hex key set 10 pivotably mounted on axes 11, suitably, at the ends of a pair of side bolsters or at opposite ends of an integrally formed one-piece handle 12. In the improved hex key hand tool of the invention, a 4-in -1 (or 8-in-1) drive tool is suitably pivotably connected at one end of an outer sleeve 14, with a removably mounted inner sleeve 16 having a pair of drive bits 18 and 20 removably retained in place by conventional biasable ball detent means, with only balls shown on the flat planar hex surfaces. Other suitable securing means, which are well known, include magnets, retaining clips, mating grooves and protrusions (ears or wings), may likewise be employed in lieu of the biasable ball detent means. The innards of the inner sleeve 16 comprise hexagonal bores which drive the hexagonal drive bits 18 or 20; and the inner sleeve 16 is also suitably connected in any conventional, removable manner, while enabling rotational transmission of torque between the inner and outer sleeves. Such well-known drive rotation connections, for example, may comprise a pair of opposite grooves (not shown) on the inner wall of the outer sleeve 14, and a mateable pair of ears (not shown) on the outer wall of the inner sleeve 16 as described hereinabove with respect to the connection between the drive bits and the inner sleeve. Alternatively, mating hexagonal elements may be used to transfer driving forces from one element or sleeve to another element or sleeve. Also, as noted herein, other more conventional means, such as the biasable ball detents, magnets, retaining clips, mating grooves and protrusions or wings (ears), etc., may be used to retain in place the drive bits in the inner sleeve and the inner sleeve in the outer sleeve, so that such elements cannot fall out or be dislodged during use.

Also shown for use with the embodiments of the improved hex key hand tool of the invention is a hexagonal crossbore 17 in the handle and side 12 where the sidewall is of a single thickness. Where a laminate of two materials are employed (see lines in phantom), dual crossbores are employed to engage both the hex drive bit and the hexagonal outer surface of the inner sleeve (not shown). Such crossbore (s) enable the tool to be used as a "T-handle" drive tool. In addition, the pivotable drive tool is preferably suitably locked in the fully extended, open, longitudinal position (or even in the right angle position or both, if desired) by any of the well known and conventional means for locking a tool or "knife blade" in place so that it cannot swing back into the closed, stored position.

It will be appreciated that a pair of 4-in 1 drive tools can be used in one end or at opposite ends of the hex key tool handle. Alternatively, in lieu of a pair of 4-in 1 drive tools, a "single" 8-in-1 drive tool could be employed, such as that disclosed in our copending U.S. patent application Ser. No. 08/620,471, filed Mar. 22, 1996, the contents of which is intended to and is hereby incorporated herein by reference. Such an 8-in-1 drive tool would, however, generally increase the length and width of the hex key tool handle to a size which would be bigger than that of a conventional hex key tool depending upon the length and diameter of the drive bits. The only difference is that a pair of inner or servant sleeves would mate with a single master sleeve, with each of the inner or servant sleeves having a pair of drive bits and with the master sleeve mating similarly with the outer sleeve. In this connection, the drive bits may be either of the male or female types, so that both regular fasteners can be driven/undriven, and also nuts (hexagonal and the like) likewise driven to a tight condition or loosened by the various hexagon tubular-like elements (bores of the inner or servant sleeves and the master bore(s) in the master sleeve and/or pivotable sleeve itself).

Figure 3:
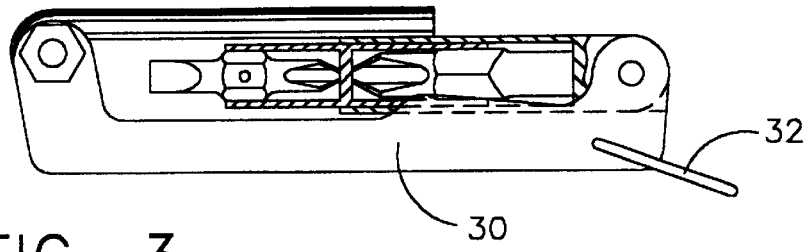
FIG. 3 is another embodiment of the improved hex key hand tool shown in a side elevational view, partly in section, but with a formed cut-away handle allowing for an improved grip by the user's fingers, and for a bigger/wider bit holder, with all hex keys and the 4-in -1 driver tool, at opposite ends of the tool handle, and with a conventional U-shaped loop for use in hanging the tool on a peg or chain.
Figure 4:
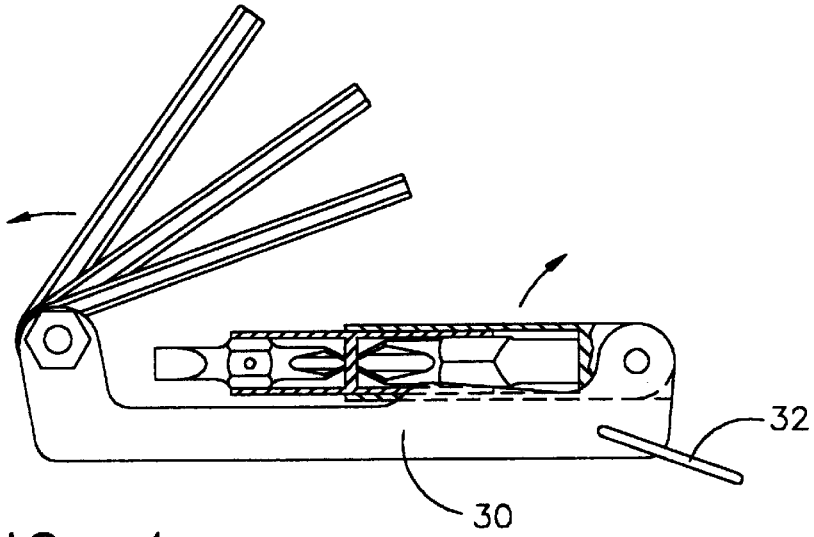
FIG. 4 is a side-elevational view, similar to that of FIG. 3, and also partly in section, but showing the hex keys pivoted out of the way for access to the 4-in 1 driver tool.
Figure 5:
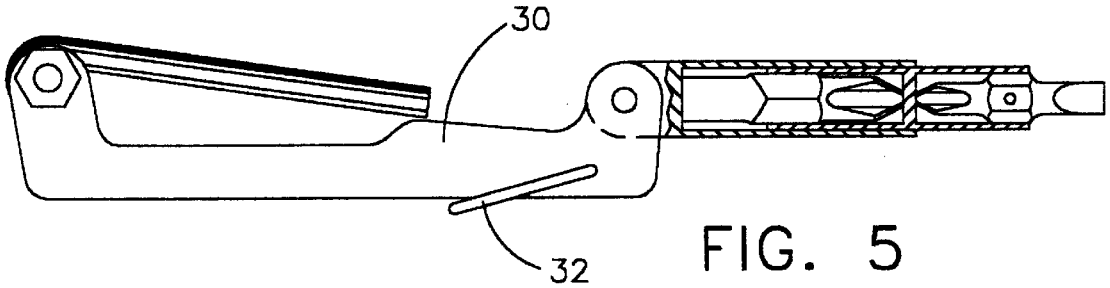
FIG. 5 is a side elevational view partly in section of the hex key hand tool of FIGS. 3 and 4, but showing the 4-in 1 driver tool in its fully extended operative position.

FIGS. 3–5, while similar to that of FIGS. 1 and 2, embody essentially an "open" cavity in a one-piece, integrally constructed handle 30. Such open cavity facilitates access to the hex keys and/or other tool implements pivotably mounted to the handle 30. The handle 30 is further provided with a conventional U-shaped loop 32 for storing of the tool on a peg or other hook, as well as for securing the tool on a chain.

Figures 6, 7, 8:
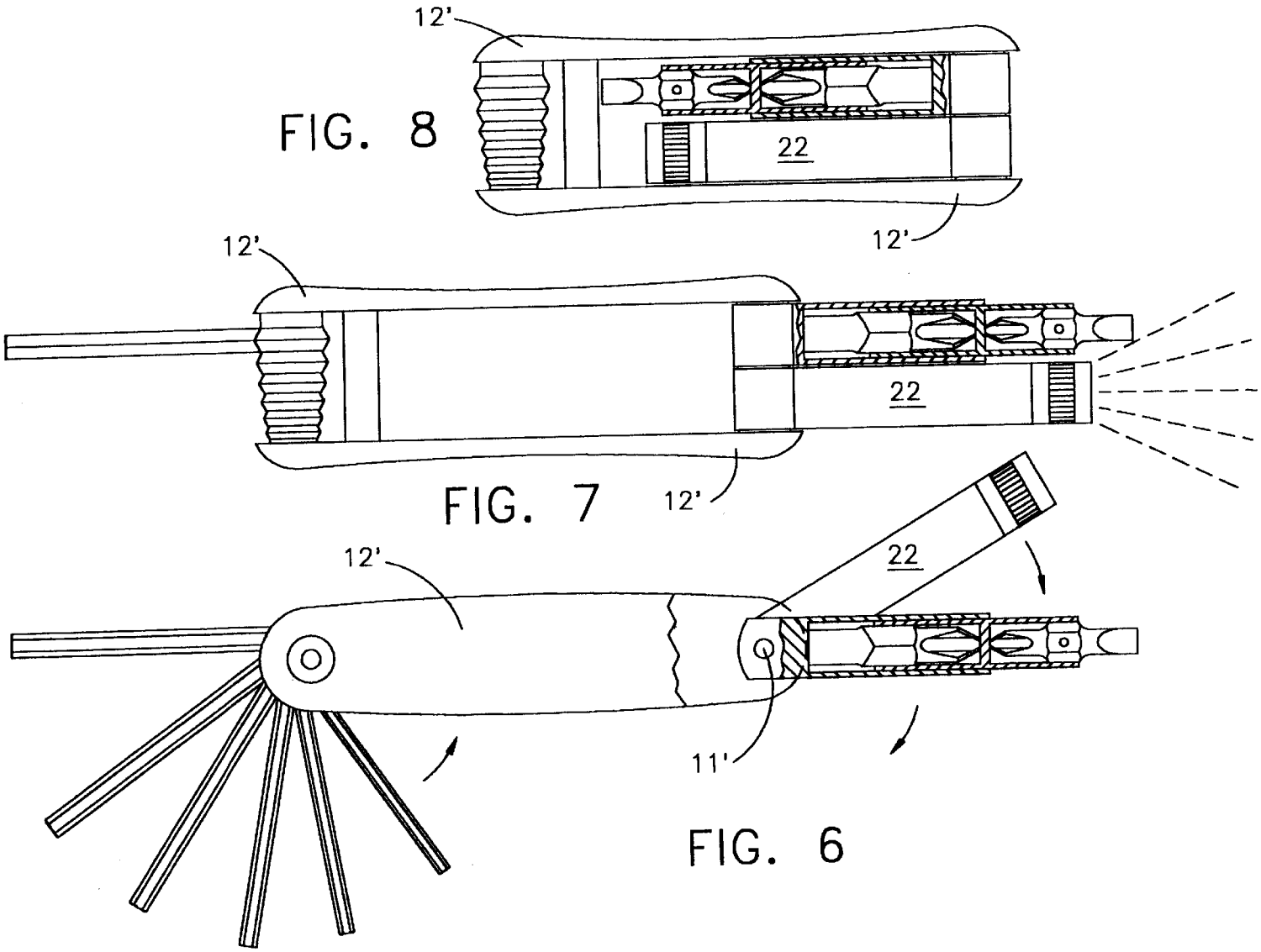
FIG. 6 is an alternative embodiment of the improved hex key hand tool of FIGS. 1 and 2, but with an additional pivotable tool, such as a small flashlight.
FIG. 7 is a plan view of the embodiment in FIG. 6 showing the 4-in 1 driver tool fully extended alongside the flashlight, and with one hex key at the opposite end fully extended outwardly with all other hex keys extended downwardly at right angles thereto with the cavity/compartment of the handle shown empty.
FIG. 8 is a plan view, similar to that of FIG. 7, but showing the 4-in-1 driver tool and flashlight in the stored position, with the set of hex keys extending downwardly at right angles to the handle for ease of illustration.

In FIGS. 6–8, which show an embodiment similar to that of FIGS. 1 and 2, there is shown the addition of a small flashlight 22 (battery operated—not shown) pivotably mounted to the handle 12' about axis 11'. Such a flashlight tool feature is convenient, and very handy, especially where the tool may be used in close dark quarters having little light source.

The improved hex key tool of the present invention provides a new tool having generally in the same single place a plurality of drive tool bits, in lieu of a plurality of separately pivoted tool blades, such as flat type, Phillips, Torx or star, pin type, etc., all of which individually take up considerable space as each only performs a single type of function, be it driving a slotted screw, Phillips head screw or other type of fastener.

Preferably, the 4-in 1 or 8-in-1 driver tool element should not normally be offset, and is centered in the tool handle so that its axis is generally in line with the rotational tool handle axis.

Figure 9:
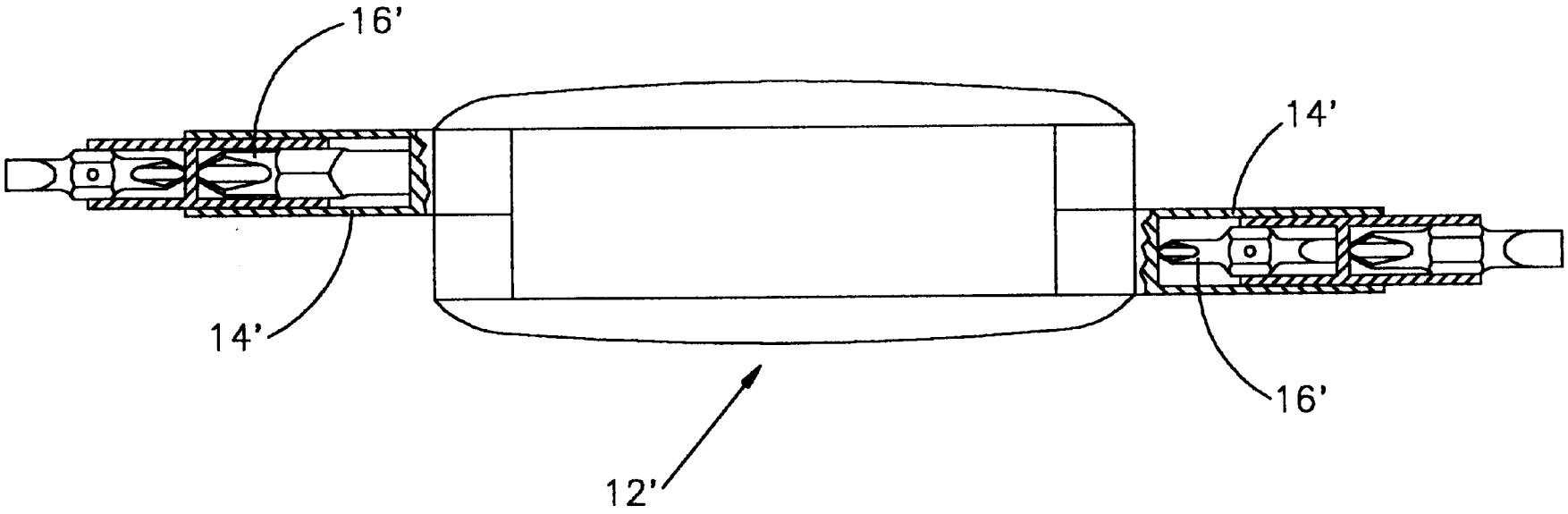
FIGS. 9–11 show a couple of alternate 8-in-1 pocket drive tools, with FIG. 9 showing in plan view, and partly in section, a pair of 4-in 1 drive tools offset from each other at opposite pivot axes of the handle.
Figure 10:
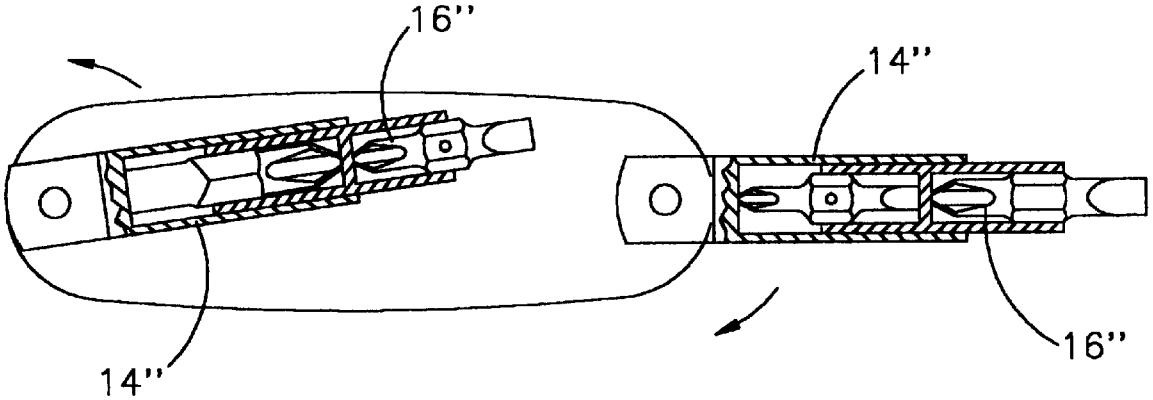
Figure 11:
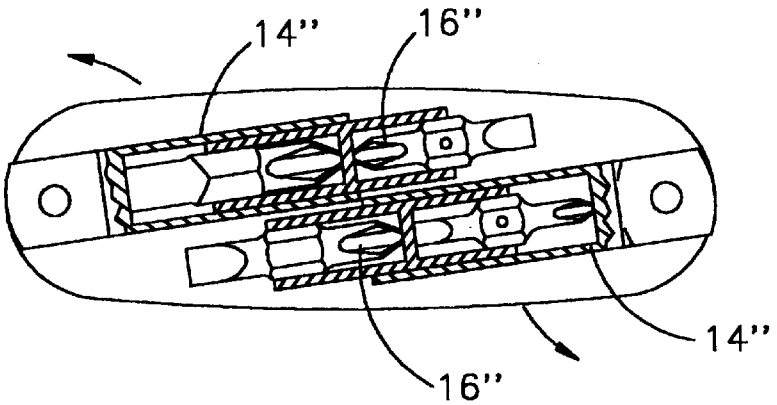

As shown in FIGS. 9–11, handle 12' with a pair of sides and pivot axes at opposite ends pivotably supports a pair of 4-in-1 drive tools with dual drive bits of varying styles and sizes releasably secured in a conventional manner, and preferably to a hexagonal inner sleeve 16' which is pivotably mounted about the oppositely disposed pivot axes by means of the outer sleeves 14'. Here the 4-in 1 drive tools are offset from each other to minimize the length of the tool handle, as if the pair of 4-in -1 drive tools were in the line with each other along the longitudinal axis of the handle, the tool handle would normally be twice as long.

Where it is preferred to have in-line "pressing-rotational" forces always acting along and about the drive tool axis (without any "eccentric" effect), the dual 4-in 1 hand tools may be disposed directly in line axially as shown in FIGS. 10–11, but here the dual 4-in-1 hand tools are stored obliquely inside the handle cavity or compartment (between the side walls). With this arrangement the handle length is basically of the same length as the tool handle of FIG. 9.

Figure 12:
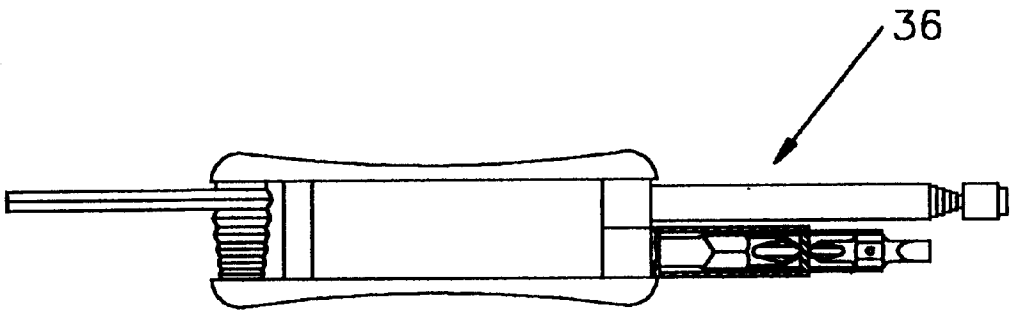
FIGS. 12 and 13 is another modification of the improved hand tool with a set of hex keys pivotable at one end, and a 4-in 1 hand tool pivotable at the opposite end of the handle and with an adjacent telescoping magnetic pick-up for use in seeking out "loose" fasteners/nuts, etc.
Figure 13:
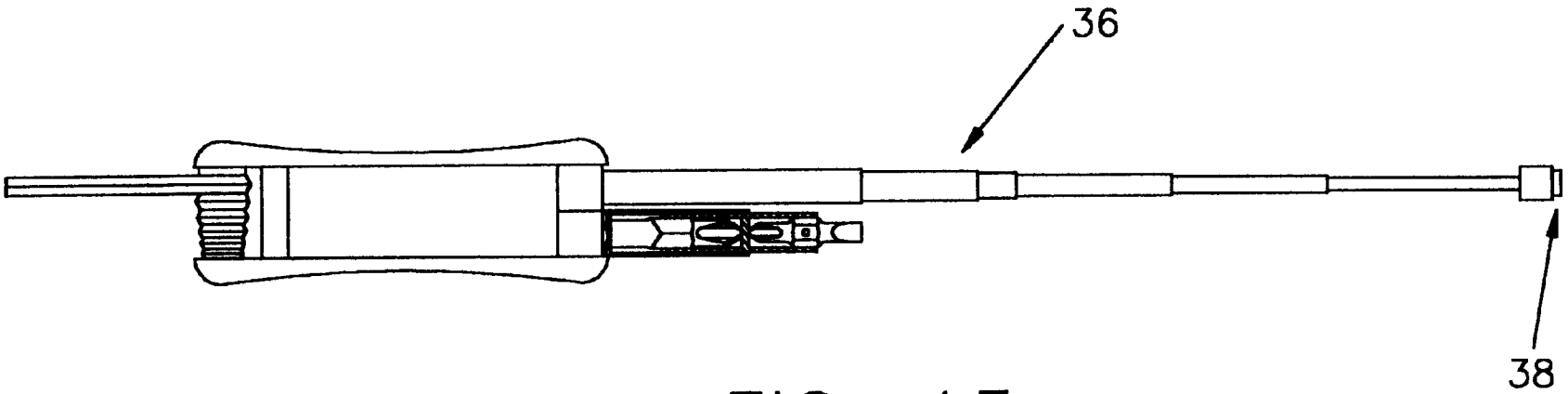

Referring now to FIGS. 12–13, the improved hand tool is shown with a set of pivotable hex keys at one end and with a pivotable 4-in-1 hand tool like that of FIGS. 1–2 and 9, and also with a telescoping element 36 having magnet means 38 suitably secured at the distal end of the telescoping sections, such as powerful disc magnets which are well known and conventional. This device is a very handy tool for facilitating the easy pick up of "loose" metal fasteners, nuts, or the like which are lost during assembly/disassembly of an apparatus, vehicle, etc., and have dropped into small crevices or other areas inaccessible to one's fingers.

Figure 14:
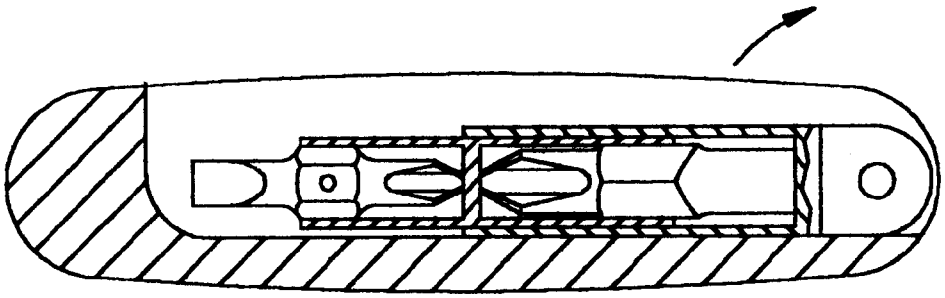
FIGS. 14 and 15 are views similar to that of FIGS. 3–5, but with a "closed-type" cutout handle, and a pivotable 4-in 1 hand tool at one end thereof.
Figure 15:
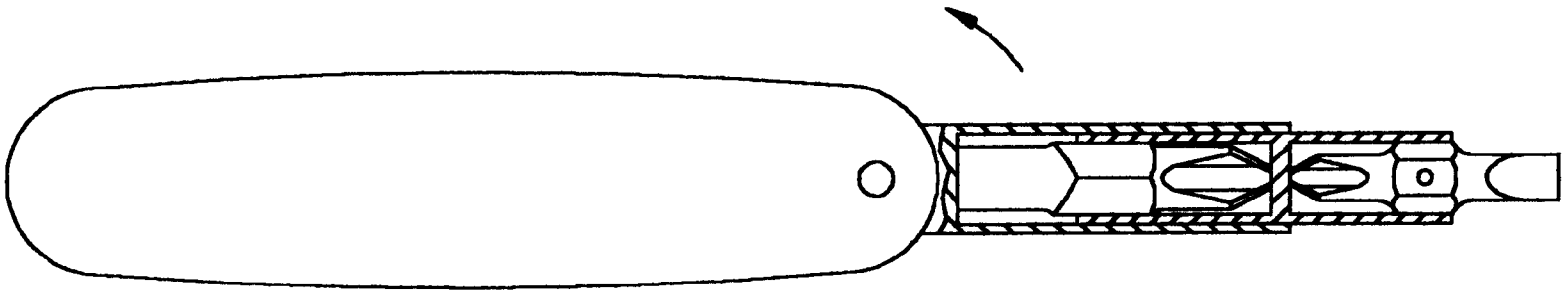
Figure 16:
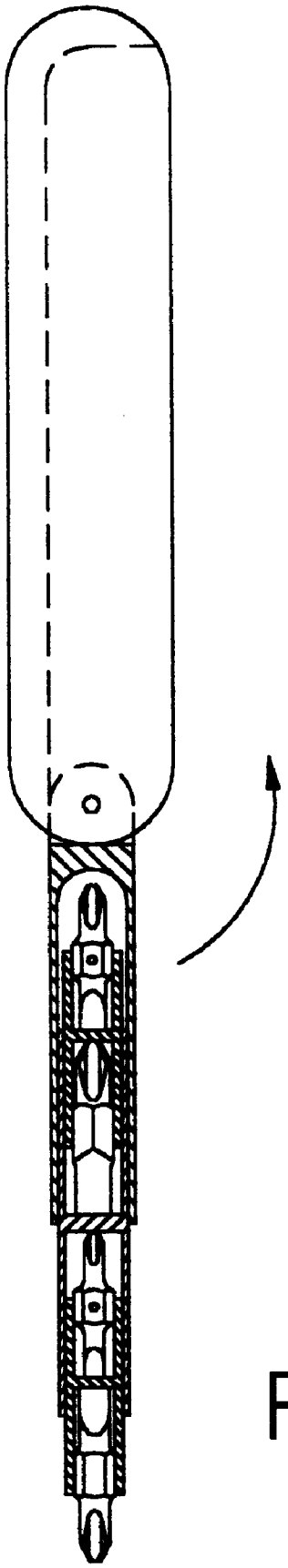
FIGS. 16 and 17 are views similar to that of FIGS. 14 and 15, but showing an 8-in-1 hand tool (in lieu of a 4-in-1 hand tool)
Figure 17:
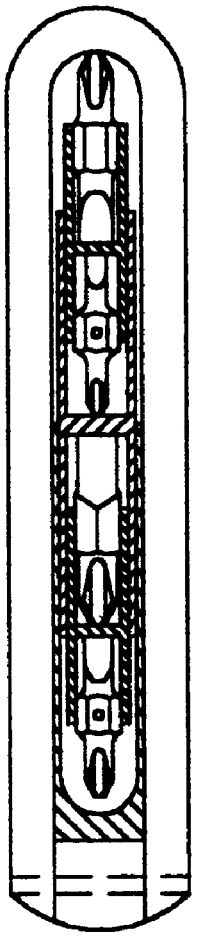

In FIGS. 14–17 simply show the improved hand tool without a set of hex keys, with FIGS. 14–15 illustrating the 4-in 1 hand tool foldable into the handle cavity/compartment, and FIGS. 16–17 illustrating the 8-in-1 hand tool foldable into the handle cavity. It will be appreciated that the tool handles of both embodiments may be generally of the same length as the length of improved hand tools of the invention are all primarily dependent upon the particular length and diameter of the drive bits, both of which can be varied to accommodate a particular sized pocket hand tool or other type drive tool.

FIGS. 18–20 are similar to that of FIGS. 16–17, but showing the 8-in-1 drive tool with the outer "master" sleeve

40 to send its inner "servant" sleeves 42 (each having a pair of drive bits of varying styles and/or sizes) removed from the pivotable sleeve 44 shown seated in the cavity/compartment of the handle in its stored position (but without the sleeve elements and their drive bits). Here all of the sleeve elements (40 and 42 and the interior of the pivoted sleeve 44 are polygonal in shape, but preferably hexagonal as shown (in lieu of other type "rotatable connection." such as the conventional mating grooves and protruding wings/ears.

Also shown in FIGS. 18 and 20 are crossbores 46 and 48, the former of a size to mate with the inner "servant" sleeves 42, and the latter to mate with the hexagonal drive bits (not shown in either of the hex holes 48 of the figures). Crossbore 50 in FIG. 20 is shown mated with the larger outer "master" sleeve 40. With this embodiment, one obtains the lever arm advantage of the handle in achieving higher torquing power.

Although the present invention has been described in some detail by way of illustration and example for purposes of clarity and understanding, it will of course be understood that various changes and modifications may be made in the form, details and arrangements of the parts without departing from the scope of the invention as set forth in the following claims.

What is claimed is:

1. A hand tool comprising:

a handle having an elongated body having oppositely disposed handle ends;

a plurality of tool bits;

first tool means comprising sleeve means, and means for pivotally connecting said sleeve means to said handle disposed adjacent one handle end, said sleeve means comprising means for removably receiving at least one said tool bit, said sleeve means being pivoted from an inoperable position adjacent the handle to an operable position disposed away from the handle, wherein said at least one said tool bit is disposed in the sleeve means in the operable position;

second tool means comprising means for engaging a tool element, and means for pivotally connecting said second tool means to the handle adjacent the other handle end, so that the second tool means is pivoted to an operable position to engage the tool element; further comprising telescoping magnet means, and means for connecting the telescoping magnet means to the handle, said means for connecting the telescoping magnet means comprising means for pivotally connecting said telescoping magnet means to said handle, whereby the hand tool is alternatively operable as a first tool, a second tool or a telescoping magnet.

2. The hand tool of claim 1, said means for pivotally connecting said sleeve means comprising a pivot axis and said means for pivotally connecting said telescoping magnet means comprising a pivot axis and wherein said pivot axes are coaxial.

3. The hand tool of claim 1, said sleeve means comprising an outer sleeve and an inner sleeve slidably removably received in the outer sleeve, said inner sleeve comprising means for removably receiving said plurality of tool bits.

4. A hand tool comprising:

a handle having an elongated body having oppositely disposed handle ends;

a plurality of tool bits;

first tool means comprising sleeve means, and means for pivotally connecting said sleeve means to said handle disposed adjacent one handle end, said sleeve means comprising means for removably receiving at least one of said tool bit, said sleeve means being pivoted from an inoperable position adjacent the handle to an operable position disposed away from the handle, wherein said at least one said tool bit is disposed in the sleeve means in the operable position;

second tool means comprising means for engaging a tool element, and means for pivotally connecting said second tool means to the handle adjacent the other handle end, so that the second tool means is pivoted to an operable position to engage the tool element; further comprising telescoping magnet means, and means for connecting the telescoping magnet means to the handle, said means for connecting the telescoping magnet means comprising means for pivotally connecting said telescoping magnet means to said handle, whereby said telescoping magnet means is pivoted from a first position in the handle to said operable position disposed away from the handle.

5. The hand tool of claim 4, said sleeve means comprising an outer sleeve and an inner sleeve slidably removably received in the outer sleeve, said inner sleeve comprising means for removably receiving said plurality of tool bits.

* * * * *